US005651581A

United States Patent [19]

Myers et al.

[11] Patent Number: 5,651,581

[45] Date of Patent: Jul. 29, 1997

[54] INFANT SEAT HANDLE

[75] Inventors: Peter J. Myers, Wheaton; Edward M. Johnson, Jr., Park Forest, both of Ill.

[73] Assignee: Kolcraft Enterprises, Inc., Chicago, Ill.

[21] Appl. No.: 532,981

[22] Filed: Sep. 22, 1995

[51] Int. Cl.[6] ..... A47C 31/00

[52] U.S. Cl. ..... 297/183.6; 297/183.1; 297/183.4; 16/110 R; 16/112; 16/125

[58] Field of Search ..... 297/183.6, 183.1, 297/183.2, 183.4; 16/125, 110 R, 112

[56] References Cited

U.S. PATENT DOCUMENTS

| | | | |
|---|---|---|---|
| 2,259,077 | 10/1941 | Morgan . | |
| 3,401,951 | 9/1968 | Bloom . | |
| 3,756,451 | 9/1973 | Popeil . | |
| 4,516,806 | 5/1985 | McDonald et al. . | |
| 5,207,476 | 5/1993 | Payne . | |
| 5,324,094 | 6/1994 | Kain . | |
| 5,409,292 | 4/1995 | Kain et al. | 297/183.1 |
| 5,516,190 | 5/1996 | Kain et al. | 297/183.6 |
| 5,544,935 | 8/1996 | Cone, II et al. | 297/183.6 X |

OTHER PUBLICATIONS

Advertisement for TurnAbout™ infant car seat, Cosco Inc., 2525 State Street, Columbus, Indiana, undated.

Pp. 1, 2, and 3 from Century Products Company 1995 product brochure, Century® SmartFit™ Infant Car Seat/Carrier With All-Ways™ Handle.

*Primary Examiner*—Peter M. Cuomo
*Assistant Examiner*—Rodney B. White
*Attorney, Agent, or Firm*—Marshall, O'Toole, Gerstein, Murray & Borun

[57] ABSTRACT

Apparatus for holding and carrying an infant in which a U-shaped handle is attached to a carrier and a second hand grip member is attached to the handle and lies in a substantially vertical plane which extends through the longitudinal axis of the carrier. The second hand grip member normally pivots about the U-shaped handle; however, if desired, it can be locked in place.

13 Claims, 4 Drawing Sheets

1/4

INFANT SEAT HANDLE

BACKGROUND OF THE INVENTION

The invention disclosed and claimed herein relates generally to apparatus for holding and carrying an infant, and, more particularly, to an improved infant carrier handle used with carrier apparatus to manually hold and transport an infant from one location to another.

DESCRIPTION OF THE PRIOR ART

There are a number of commercial infant carrier systems available for carrying infants. These systems generally include an infant carrier which is made of a suitable molded plastic material. A movable handle, generally of a U-shaped configuration, is coupled by pins or other fastener means to the sides of the carrier shell. The U-shaped handle, which traverses the carrier, includes a base member and two legs located at the end of the base member. The outboard ends of the legs are attached to the carrier side and are adapted to pivot about the carrier. In use, an infant is placed in the carrier and transported from one location to another by an individual who grasps the handle base and lifts and moves the carrier. Because the handle base traverses the carrier, an individual transporting the carrier rotates his or her carrying hand, wrist and arm approximately 90° from the normal hand, wrist and arm position. When an individual is required to carry an infant a substantial distance, the muscles of the carrying arm, wrist, and/or hand sometimes will become fatigued or irritable due to the unnatural twisting which occurs.

To offset this disadvantage, it is known to incorporate a handle in the carrier handle base, which is oriented along the longitudinal axis of the carrier. An individual, upon grasping the handle, carries the infant carrier without the carrying arm, wrist and hand being displaced 90° from their normal positions. An example of this type carrier handle system is disclosed in U.S. Pat. Nos. 5,324,094 and 5,207,476. The system of the '094 patent utilizes a Z-shape handle configuration whereby the hand grip is positioned along the longitudinal axis of the carrier. The carrier handle disclosed in the '476 patent includes two spaced Y-shaped members. A pair of parallel bar members traverse the carrier shell connecting the legs of the Y-shape members. A hand grip is connected at its respective ends to each bar member so that the handle extends along the longitudinal axis of the carrier. Neither of these handle systems is entirely satisfactory. One utilizes a Z-shaped handle which is not particularly desirable in all instances whereas the system of the '476 patent is somewhat bulky as it utilizes a plurality of bar members to which a handle grip is attached.

What is desired is to have an infant carrier which can be carried and transported manually from one location to another by an individual without any substantial movement of the individual's arm, wrist and hand from their normal positions.

It also is desired to have a handle for an infant carrier which is not bulky and utilizes few parts for the system while at the same time permitting an individual to carry the carrier with relatively little discomfort. What is desired is to have an infant carrier which utilizes a U-shaped member but which also includes a second hand grip member which is located along the longitudinal axis of the carrier and is adapted to pivot about the first carrier handle.

SUMMARY OF THE INVENTION

Briefly, applicants' invention, as disclosed and claimed herein, is directed to an infant carrier having a handle member whose free ends are pivotally connected to an infant carrier such as an infant car seat.

The handle member generally is U-shaped in configuration and includes a relatively straight handle base member which traverses the carrier shell. Two legs extend from the base with the outboard ends of each leg being pivotally connected to the carrier shell. A second, oval-shaped hand grip member is disposed on the handle member base. The second hand grip member is positioned to lie in a substantially vertical plane which extends through the longitudinal axis of the carrier. Normally, the hand grip member is adapted to pivot relative to the handle base member. If desired, the hand grip member may be selectively locked in position relative to the handle base member whereby the hand grip member is fixed relative to the base member. The carrier system of the present invention permits an individual to hold and carry an infant in the carrier without the need to twist the carrier's arm, wrist or hand from their normal position.

Permitting the hand grip member, which lies in the substantially vertical plane, to pivot about the handle base member, serves to ease the strain on an individual's wrist when the carrier seat is lifted or placed in an awkward position. The ability to pivot the hand grip member in the manner disclosed and claimed herein also allows a child located in the carrier to be soothed by gently rocking the carrier back and forth relative to the pivoting hand grip member, the carrier moving along the longitudinal axis of the carrier.

DETAILED DESCRIPTION OF THE DRAWINGS

Figure 1:
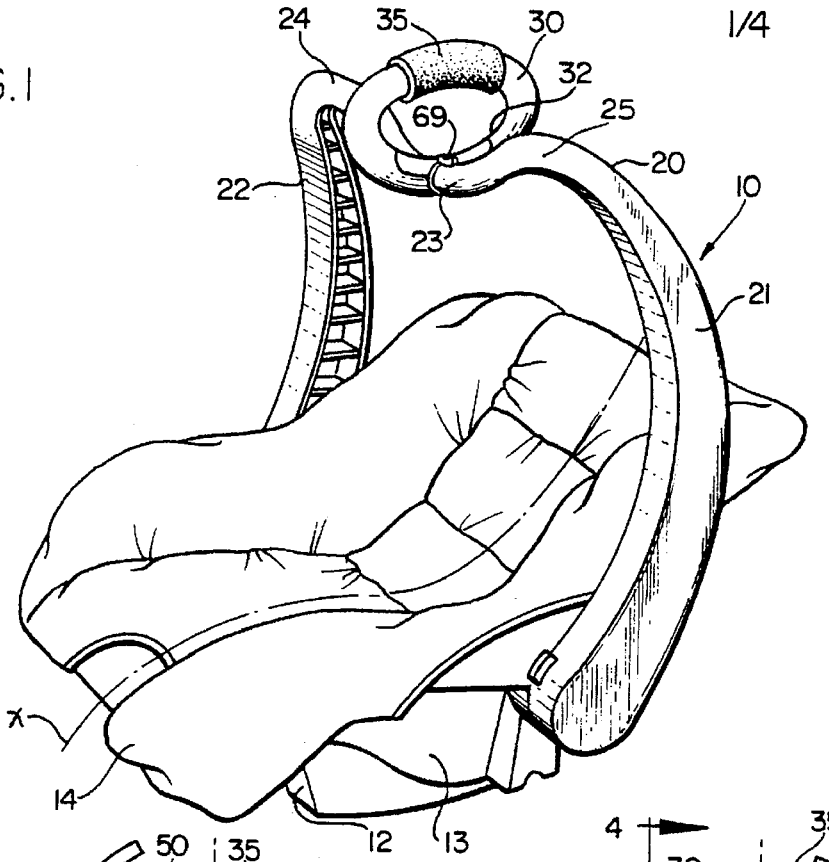
FIG. 1 shows a perspective view of the infant carrier having the hand grip member of the present invention.

Referring to the drawings, FIG. 1 shows infant carrier 10 which comprises a plastic molded carrier shell having head or front end 11, foot or back end 12 and spaced parallel side members 13. A conventional soft cloth or plastic pad 14, which is disposed in the seat formed by the shell ends and side walls, is sized and configured to receive an infant in the carrier.

Figure 4:
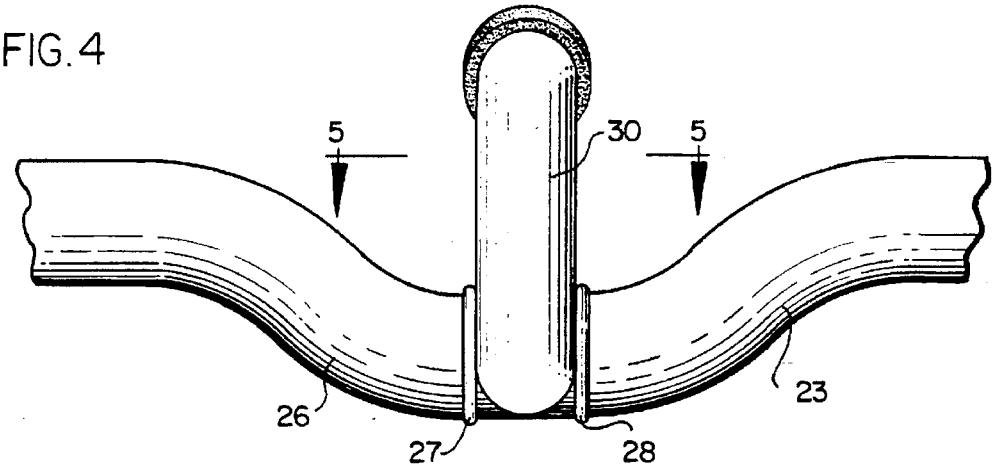
FIG. 4 shows a fragmentary front view of the infant carrier of FIG. 1 taken along lines 4—4 in FIG. 3 with the oval-shaped hand grip member disposed along the longitudinal axis of the carrier.

Handle 20 is a molded plastic member, such as polypropylene, having a generally U-shaped configuration and comprising two legs 21, 22. The outboard end of each leg is connected to carrier 10 at a suitable pivot point located along a side wall whereby handle 20 is adapted to pivot relative to carrier shell 10. The remaining end of each leg terminates as one of the ends 24, 25 of handle base member 23. Base member 23 traverses carrier shell 10, the base member preferably lying in a plane which extends along a traverse axis of the carrier. As seen more clearly in FIG. 4, the middle of base member 23 angles downwardly toward the shell to form member section 26 which is positioned slightly below the remaining portion of base member 23. Section 26 includes two spaced circular ridges 27, 28 which provide raised areas between which is located reduced diameter handle portion 29.

Figure 7:
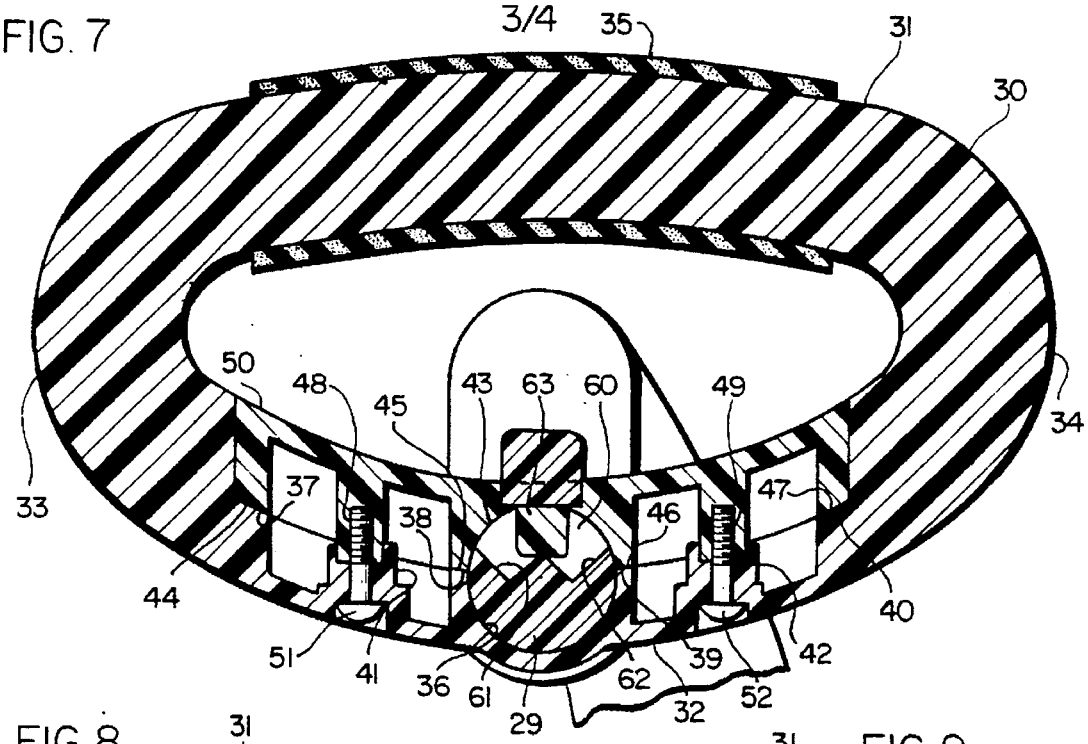
FIG. 7 shows a section view of the oval-shaped handle taken along lines 7–7 in FIG. 6.
Figure 8:
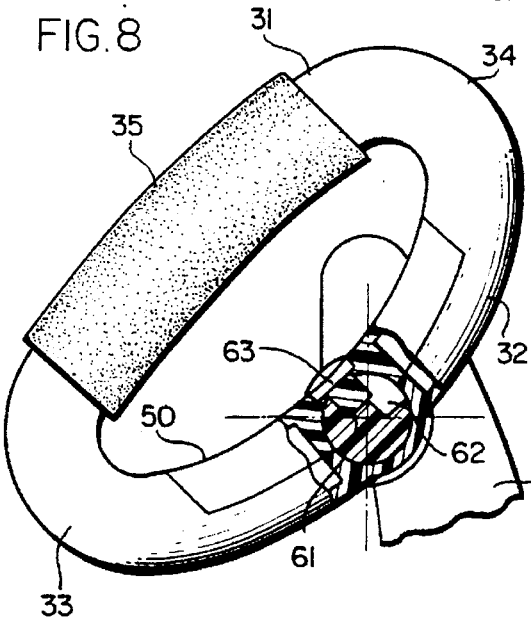
FIG. 8 shows a side fragmentary view of the oval-shaped hand grip member pivoted in a first direction.
Figure 9:
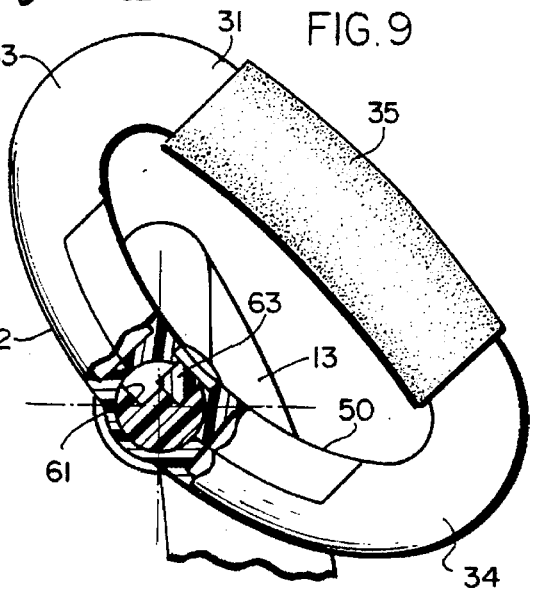
FIG. 9 shows a side fragmentary view of the oval-shaped hand grip member pivoted in a second direction opposite the first direction shown in FIG. 8.
Figure 10:
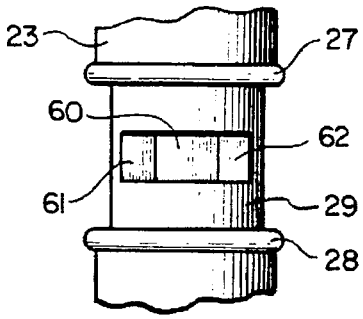
FIG. 10 shows a fragmentary plan view of the handle base member with a plurality of pivot stop notches therein; and, FIG. 11 shows a fragmentary perspective view of the oval-shaped hand grip member having a circular groove which is adapted to receive a reduced diameter circular portion of the handle base member.
Figure 11:
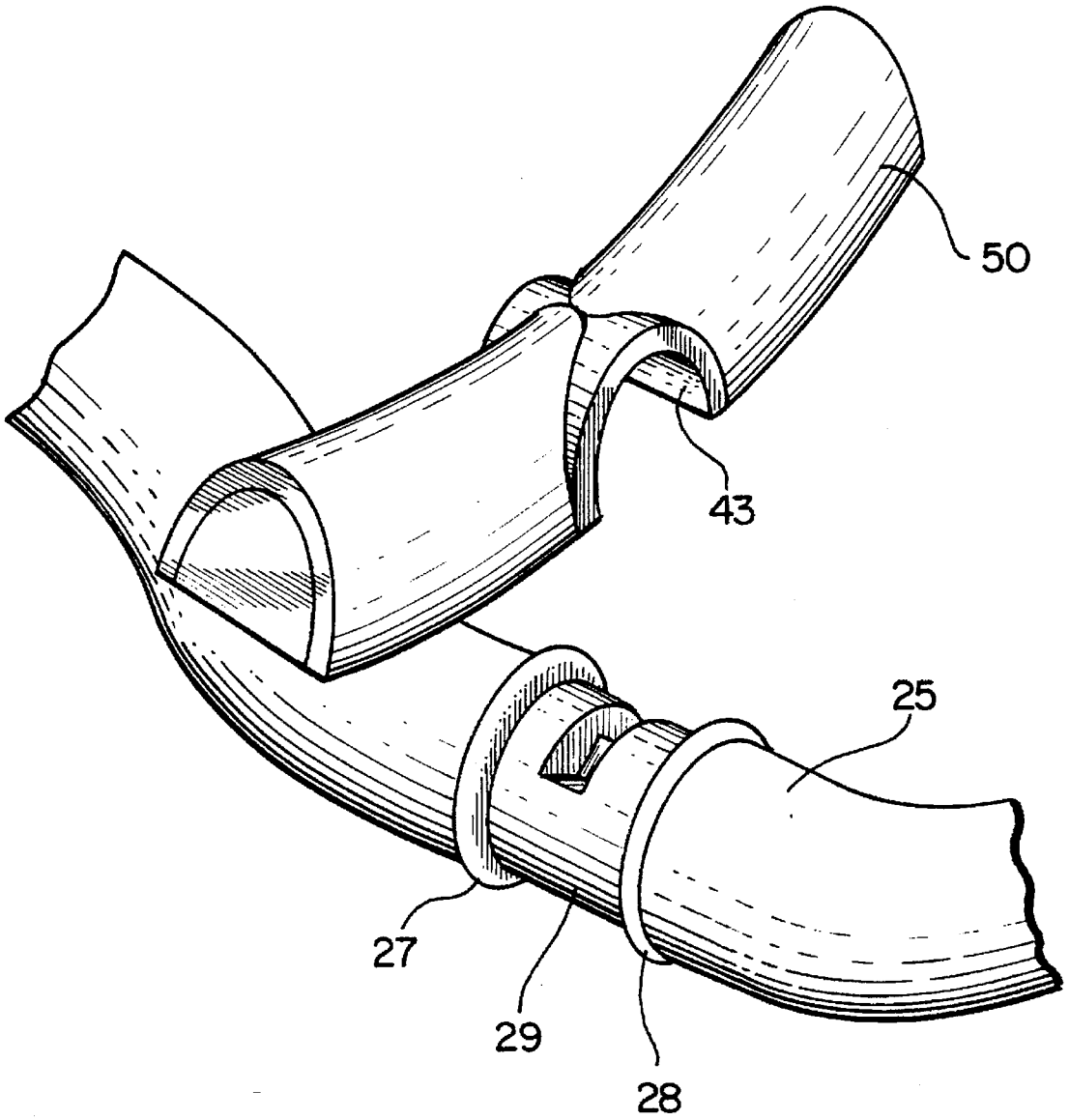

Hand grip member 30, FIGS. 1 and 7, is an oval-shaped member and comprises hand grip portion 31 and base member attachment portion 32 which are connected together by U-shaped hand grip ends 33, 34. Hand grip member 30 is disposed on handle base member 23 at the location of handle portion 29. Hand grip member 30 preferably is located in a substantially vertical plane which extends through the longitudinal axis "X" of the carrier. A flexible plastic or rubber sheath 35 is positioned over hand grip portion 31.

Attachment portion 32 is recessed at various locations, as seen for example in FIG. 7, to form circular groove 36, wall surfaces 37, 38, 39, 40 and attachment bosses 41, 42. Cover member 50 formed of a suitable plastic material having circular groove 43, wall surfaces 44, 45, 46, 47 and threaded fastener openings 48, 49 is adapted to seat in the recess area of hand grip portion 32.

In assembly, handle portion 29 seats in groove 36. Cover member 50 is placed over circular handle portion 29 at the location of groove 43 so that cover wall surfaces 44, 45, 46, 47 contact wall surfaces 37, 38, 39, 40 respectively. Circular grooves 36, 43 are adapted to snugly contact circular handle portion 29 whereby handle grip member 30 can rotate about handle base member 23. Fasteners 51, 52 are threaded into threaded openings 48, 49 to anchor hand grip member 30 to handle base member 23 Whereby hand grip member rotates about the base member. The hand grip member is precluded from any substantial lateral movement on base member 23 by ridges 27, 28 which abut or are contiguous to the sides of the hand grip member.

Referring to FIGS. 7–11, handle portion 29 is notched at 60 to include a plurality of pivot stops 61, 62. Boss 63 integrally attached to cover member 50 is adapted to seat in notched area 60. As hand grip member 30 pivots about base member 23, member 30 can travel in the direction shown in FIG. 8 until boss 63 contacts a wall of pivot stop 61 formed by notch 60. Similarly, grip member 30 may travel relative to base member 23 in the direction shown in FIG. 9 until boss 63 contacts Pivot Stop 62 formed by notch 60. Thus, as exemplified in FIGS. 7–9, hand grip member 30 is capable of pivoting 45° on each side of the vertical axis for a total pivot range of 90°.

Figure 2:
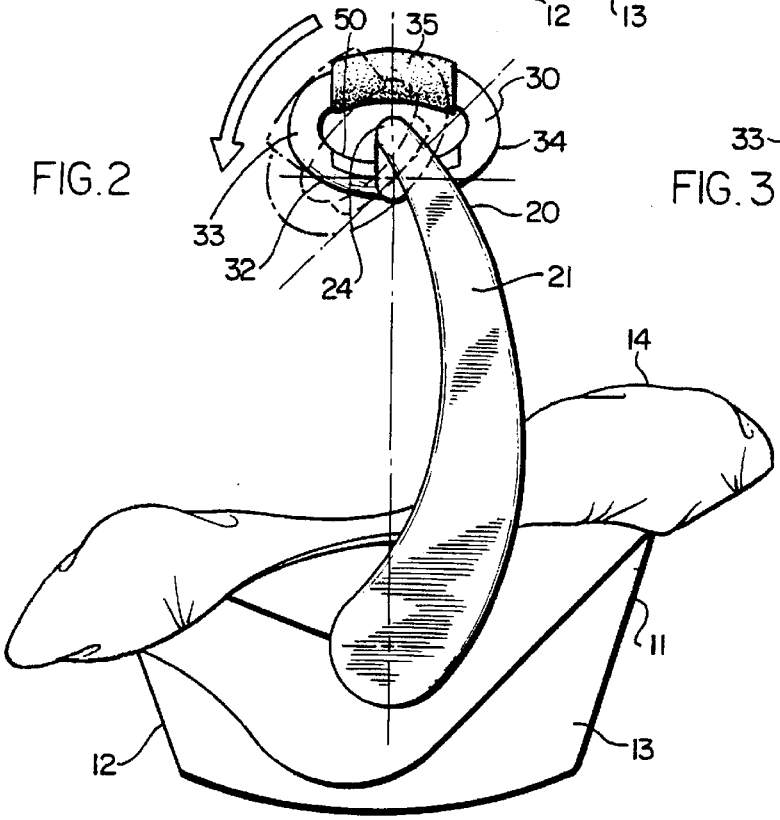
FIG. 2 shows a side view of the infant carrier of FIG. 1 with the oval-shaped hand grip member pivoted 45° in a first direction
Figure 3:
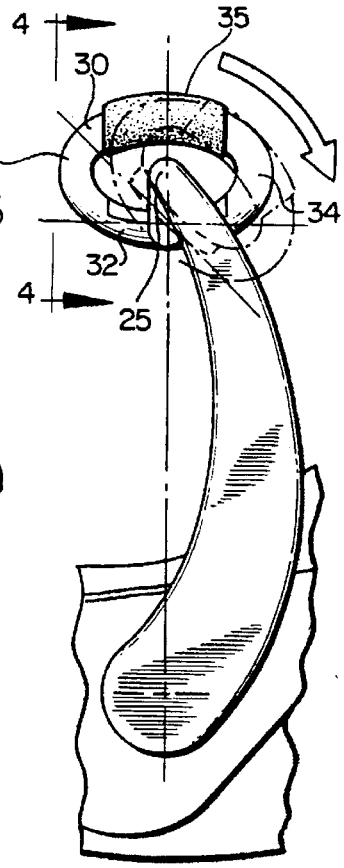
FIG. 3 shows a side view of the infant carrier of FIG. 1 with the oval-shaped hand grip member pivoted 45° in a second direction opposite the direction shown in FIG. 2.
Figure 5:
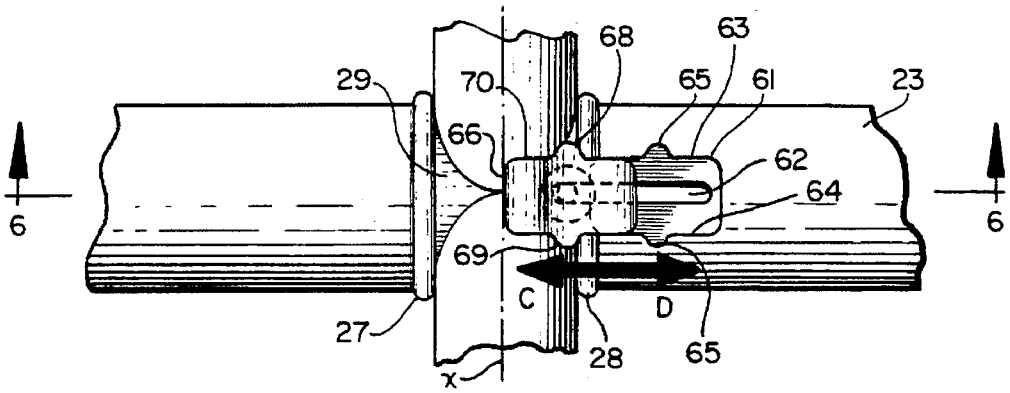
FIG. 5 shows a fragmentary plan section view taken along lines 5—5 in FIG. 4
Figure 6:
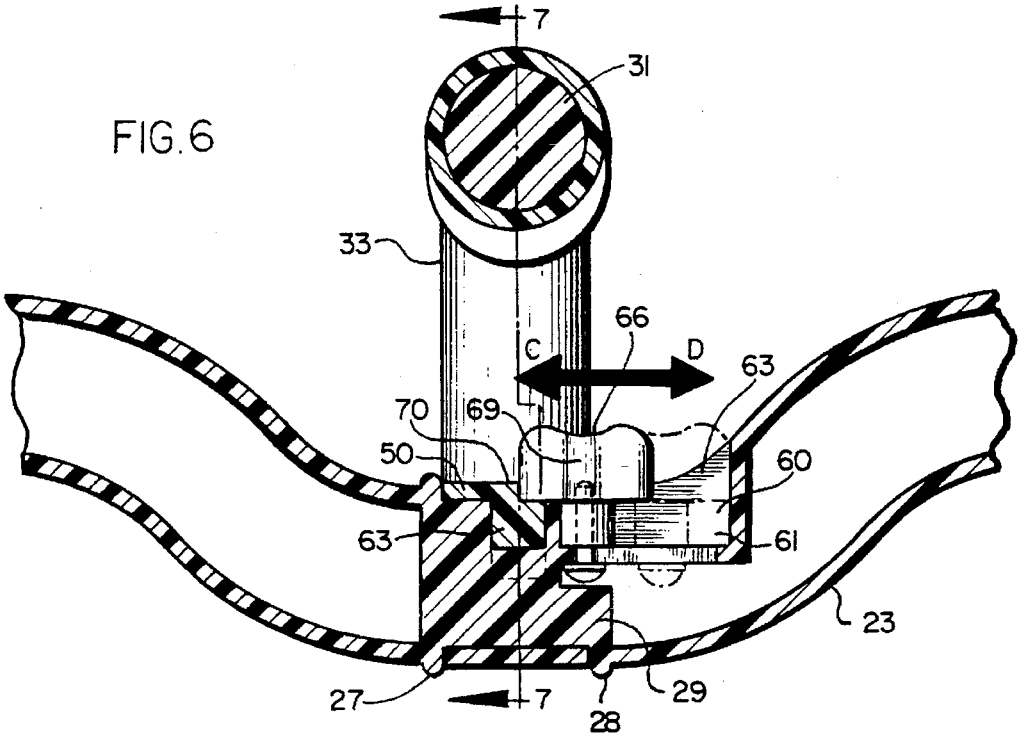
FIG. 6 shows a fragmentary front section view taken along lines 6—6 in FIG. 5.

If desired, a lock system is available to lock hand grip member 30 in a stationary position as illustrated in FIGS. 1 and 7. The lock system is shown more clearly in FIGS. 5–7. Base member 23 has a recess 80 which is formed by bottom wall 81, which is slotted at 82, and spaced side walls 83, 84, each of the side walls having a groove 85. Stop member 86 is sized and configured to fit into recess 60 and is slidably retained therein by means of a screw fastener 67 which passes through slot 85 and threads into the bottom wall of stop member 86. Member 86 also includes detents 68, 69 which extend outwardly from the respective side walls. As shown in FIGS. 5 and 6, stop member 86 normally is positioned and retained in recess 80 with detents 68, 69 disposed in grooves 85. When stop member 86 is in this position, hand grip member 30 is adapted to pivot about handle base member 23 as shown in FIGS. 1–3 inclusive whereby the hand grip member will pivot 45° either in the direction of arrow "A" or arrow "B." If it is desired to lock hand grip 30 in the position shown in FIG. 1, stop member 86 is manually pushed in the direction of arrow "C" shown in FIG. 6. In this position, a portion of stop member 86 is disposed in recess 80, FIG. 6, formed in hand grip member 30 thereby precluding hand grip member 30 from pivoting about handle portion 29. To resume a pivoting movement of hand grip member 30, stop member 86 is manually pushed in the direction of arrow "D" until such time as detents 68, 69 are seated in grooves 85.

The present invention thus provides a device for holding and carrying an infant which comprises a carrier having front and back ends and spaced side walls with a longitudinal axis extending between the side walls. A U-shaped handle is pivotally attached to the carrier side walls, the handle having a base member and two spaced legs extending outwardly from the base member. The outboard ends of the legs are pivotally attached to the carrier. A second member comprising an oval-shaped hand grip member is disposed on and adapted to pivot about the base member, the second member being in a substantially vertical plane which extends through the longitudinal axis of the carrier. If desired, the second member can be locked in position relative to the handle member.

While the present invention has been described in connection with a single embodiment, it will be understood to those skilled in the art that many changes and modifications may be made without departing from the true spirit and scope of the invention. It is therefore intended by the appended claims to cover all such changes and modifications which come within the true spirit and scope of the invention.

What is claimed is:

1. Apparatus for holding and carrying an infant comprising:

a carrier having a front end, back end and a pair of spaced apart side members, the carrier having a longitudinal axis extending between the side members from one carrier end to the other carrier end;

a handle for carrying said carrier, said handle comprising a U-shaped member;

said U-shaped member comprising a base member having two ends which traverses the carrier and a pair of handle legs, each leg having a first end and a second end, each handle leg having one end extending from one of the two base member ends and the second leg end being connected to one of said carrier side members; and, a handle grip member pivotally connected to said handle base member and positioned to pivot about said base member in a substantially vertical plane extending through the longitudinal axis of said carrier.

2. Apparatus for holding and carrying an infant in accordance with claim 1 wherein said handle grip member is an oval-shaped member which includes a hand grip portion and a base member attachment portion.

3. Apparatus for holding and carrying an infant in accordance with claim 2, wherein said base member includes a reduced portion which is substantially circular in cross section and said attachment portion includes a circular groove adapted to receive said reduced circular portion and a cover member having a circular groove adapted to receive said reduced circular portion, said cover member being connected to said base member attachment portion.

4. Apparatus for holding and carrying an infant in accordance with claim 3 and further including means for limiting the amount of travel of said handle grip member about said base member.

5. Apparatus for holding and carrying an infant in accordance with claim 3 and further including locking means for precluding said second member from pivoting about said base member.

6. Apparatus for holding and carrying an infant comprising:

a carrier having a front end, back end and a pair of spaced apart side members, the carrier having a longitudinal axis extending between the side members from one carrier end to the other carrier end;

a handle for carrying said carrier, said handle comprising a U-shaped member;

said U-shaped member comprising a base member having two ends which traverses the carrier and a pair of handle legs, each handle leg having one end extending from one of the two base member ends and a second leg end which is connected to a carrier side member; and, an oval-shaped handle grip member pivotally connected to said base member and located in a substantially vertical plane which extends through the longitudinal axis of said carrier.

7. Apparatus for holding and carrying an infant in accordance with claim 6 wherein said base member includes a portion which is circular in diameter;

said oval-shaped member including a hand grip portion and a base member connection portion;

said connection portion including a circular groove;

a cover member having a circular groove; and, said connection portion and cover member portion being connected to each other whereby said base member portion seats in said grooves.

8. Apparatus for holding and carrying an infant in accordance with claim 7 wherein said base member portion includes at least one notch and said cover member includes a boss adapted to seat in said notch to limit the amount of movement of said oval-shaped member relative to said base member.

9. Apparatus in accordance with claim 8 wherein said base member portion includes a plurality of said notches and said boss is adapted to seat in each of said notches to limit the amount of movement of said oval-shaped member relative to said base member.

10. Apparatus in accordance with claim 7 and further including a movable lock member for locking said oval-shaped member in position relative to said base member.

11. Apparatus in accordance with claim 10 wherein said base member and said oval-shaped member each include a recess;

said lock member being adapted to seat in said base member recess, said base member having a slot therein extending along the length of said recess;

a fastener extending through said slot for fastening said lock member to said base member whereby said lock member is adapted to travel along the length of said slot; and, said lock member further including a portion adapted to seat in said oval-shaped member recess whereby, when said lock member is seated in said oval-shaped member recess, said oval-shaped member is precluded from pivoting about said handle base member.

12. Apparatus for holding and carrying in accordance with claim 6 wherein said base member is located in an axis which traverses the width of said carrier.

13. Apparatus in accordance with claims 1 or 6 and further including a lock member movable between said carrier handle and said handle grip member for selectively precluding movement between said carrier handle and said handle grip member.

* * * * *